United States Patent [19]

van der Meulen et al.

[11] Patent Number: 4,715,510

[45] Date of Patent: Dec. 29, 1987

[54] SET UP PIECE FOR MOUNTING ON A CAN, CONTAINING A BEVERAGE

[75] Inventors: Leendert van der Meulen, 1804 Bayshore Road, SW., Calgary, Alberta, Canada, T2V 3M1; Adriaan Van Der Wouden, Ulvenhout, Netherlands

[73] Assignee: Leendert van der Meulen, Calgary, Canada

[21] Appl. No.: 834,771

[22] Filed: Feb. 28, 1986

[30] Foreign Application Priority Data

Mar. 1, 1985 [NL] Netherlands ..... 8500574

[51] Int. Cl.[4] ..... B65D 25/48

[52] U.S. Cl. ..... 220/90.4; 220/90.6; 222/570; 222/531

[58] Field of Search ..... 220/90.4, 90.6; 222/531, 548, 567, 570

[56] References Cited

U.S. PATENT DOCUMENTS

| | | | |
|---|---|---|---|
| 2,075,721 | 3/1937 | Hommel | 220/90.6 |
| 2,725,732 | 12/1955 | Somoza | 220/90.6 |
| 2,729,956 | 1/1956 | Gilbert | 220/90.4 |
| 2,782,614 | 2/1957 | Currie | 220/90.6 |
| 3,085,710 | 4/1963 | McIlroy | 220/90.4 |
| 3,103,297 | 9/1963 | Taft | 220/90.2 |
| 3,185,341 | 5/1965 | Barbour | 220/90.6 |
| 3,372,832 | 3/1968 | Yeater et al. | 222/570 X |
| 3,907,172 | 9/1975 | Curtis | 222/189 |
| 3,972,453 | 8/1976 | Kapples | 222/570 X |
| 4,054,205 | 10/1977 | Blow, Jr. et al. | 206/217 |
| 4,098,439 | 7/1978 | Blow, Jr. et al. | 220/90.6 X |
| 4,099,642 | 7/1978 | Nergard | 220/90.4 |
| 4,322,014 | 3/1982 | Philip | 220/855 P |
| 4,403,709 | 9/1983 | Meins et al. | 220/90.4 |
| 4,412,629 | 11/1983 | Dart et al. | 220/90.4 |
| 4,415,097 | 11/1983 | Meins | 220/90.4 |
| 4,428,498 | 1/1984 | Obey | 220/367 |

FOREIGN PATENT DOCUMENTS

| | | |
|---|---|---|
| 35480 | 5/1983 | Australia . |
| 3331741 | 3/1985 | Fed. Rep. of Germany . |
| 8302980 | 3/1985 | Netherlands . |

*Primary Examiner*—Steven M. Pollard

*Attorney, Agent, or Firm*—Schwartz, Jeffery, Schwaab, Mack, Blumenthal & Evans

[57] ABSTRACT

A set up piece for drinking a liquid contained in a can which can is provided with a lid portion which can be torn away for obtaining an opening in the lid. The set up piece comprises a substantially cylindrical body portion which can be clamped onto the can in such a way that a liquid impervious closure is obtained. The cylindrical wall of the set up piece is connected to an inwardly running radial portion for contacting the lid of the can when the set up piece is mounted on said can.

10 Claims, 9 Drawing Figures

SET UP PIECE FOR MOUNTING ON A CAN, CONTAINING A BEVERAGE

BACKGROUND OF THE INVENTION

1. Field of the Invention

The invention relates to a set up piece for mounting on a can, containing a beverage. In the lid of such a can a substantially triangular opening can be made by tearing a part of the lid away by means of a riveted ring and an impressed rill.

2. Related Art

The relevant cans are marketed at a large scale for the sales of various types of liquids, such as beer, lemonades, spring en mineral water, fruit juices and the like.

The opening which can be made in the can has a slender triangular shape, the basis of which runs along the rim of the lid whereas the top is positioned at about the center of the lid.

Such cans, generally, are not daily domestically used but are, for example, used on the road in vehicles and at locations where many people are gathering, such as sport events and the like. In general no drinking glasses will then be available, thus forcing the consumer to drink directly from the can. This is not very convenient in particular for younger children. Moreover the taste of the liquid is not brought out in this way as the flavour is not smelled.

OBJECTS AND SUMMARY OF THE INVENTION

The invention has as an object to solve these problems and to this end is providing a set up piece comprising a substantially cylindrical body portion which near its lower rim is provided with clamping means for obtaining a liquid tight connection between the set up piece and said can, said body portion having a substantially radially inwardly extending part which can engage the upper rim of a can.

According to a preferred embodiment of the set up piece according to the invention the inwardly extending part of the body portion is forming a bottom which is provided with an opening corresponding with the one which can be made in the lid of the can.

In this way it is possible to close the opening of the can by rotating the set up piece in respect of the can. It will be obvious, that in many cases the content of the can is not consumed in one time but with intervals. If in such an interval the can would be overturned a part of the content should get lost and the environment in which the liquid is consumed might be defiled. By means of the set up piece according to the present invention this can be prevented.

According to an embodiment of the set up piece according to the invention the clamping means for obtaining a liquid tight connection between the set up piece and the can may have the shape of a skirt substantially extending from the joint between the cylindrical body portion and the radially inwardly extending part.

In particular the skirt may extend over a given portion of the cylindrical wall of the can, the lower edge of the skirt being provided with an inwardly extending rib engaging said cylindrical wall of the can.

By this an excellent seal between this wall of the can and the set up piece can be obtained while nevertheless the set up piece can easily be mounted on the can.

In case the set up piece is provided with a bottom the rotation of the set up piece in respect of the can e.g. when closing the opening in the lid of the can, is not hampered by the inwardly extending rib engaging said cylindrical wall of the can.

The embodiment described above is preferred in view of the fact that most types of cans containing a beverage are having the same outside diameter. The cans, however, thus show several shapes of the upper part of the cylindrical wall where this is joining the lid and of the connection between said wall and said lid.

For some types of cans use can be made of a clamping means in the shape of a skirt substantially extending from the joint between the cylindrical body portion and the bottom and of a raised bottom portion positioned opposite said skirt, said skirt and raised bottom portion cooperating with an upstanding rim portion of the lid of the can by which said lid is connected to the cylindrical wall of said can.

In view of the fact that the upper surface of the lid of a can is not entirely flat the lower surface of the bottom of the set up piece can not lie against the lid over its entire surface. By this the danger exists that liquid will pass along the lower surface of the bottom of the set up piece to the opening in the bottom also when this opening is not in line with the one in the lid of the can, so when the already opened can should have to be closed off by the set up piece.

To prevent this according to the invention the lower surface of the bottom of the set up piece is provided with a protruding portion extending substantially along the edge of the bottom opening.

According to a preferred embodiment said protruding portion can be obtained by the fact that the bottom of the set up piece is somewhat slanting towards the edge of the bottom opening over a small distance near said opening.

Further it is preferred that the edge of the bottom opening near that portion where this is nearest to the cylindrical wall, is provided with a raised portion.

It has appeared that by this it is prevented that the last droplets, which will be present on the bottom near the cylindrical wall are sucked between the bottom of the set up piece and the lid of the can.

Further it has appeared to be favourable when the end of the opening in the bottom of the set up piece lying near the centre of this is formed by a straight line perpendicular to the radius forming the centre line of the opening.

It has appeared that when the shape of the opening at the indicated place is more rounded off droplets will easier be sucked into the space between the bottom of the set up piece and the lid of the can.

According to a further elaboration of the invention the bottom of the set up piece can be provided with a raised centre portion by which it is prevented that the bottom contacts a part of the means by which the opening in the lid of the can is originally closed and which part, eventually, is not totally removed when opening the can.

Further the bottom of the set up piece can be provided with a raised annular portion extending along the cylindrical body portion to prevent that the bottom of the can contacts an upstanding rim of a given type of can before the bottom contacts the lid of the can in the desired way.

According to the present invention the body portion of the set up piece can be substantially dimensioned such that it partly fits upsidedown over the can and as such does not take much space in the packaging of a number of cans.

Alternatively the set up piece can be dimensioned such that a number of set up pieces may be slit into each other, so that a number of set up pieces occupy the same volume as one can.

As already indicated above a set up piece, provided with a bottom, can be rotated around its longitudinally axis with respect to the can, after being clamped on said can. In this way the opening in the bottom of the set up piece is turned in respect of the opening in the lid of the can to close said opening after the related portion of the lid of the can has been removed.

BRIEF DESCRIPTION OF THE DRAWINGS

The invention will be further elucidated on the hand of embodiments shown in the drawing, in which.

DETAILED DESCRIPTION OF THE INVENTION

Figure 1:
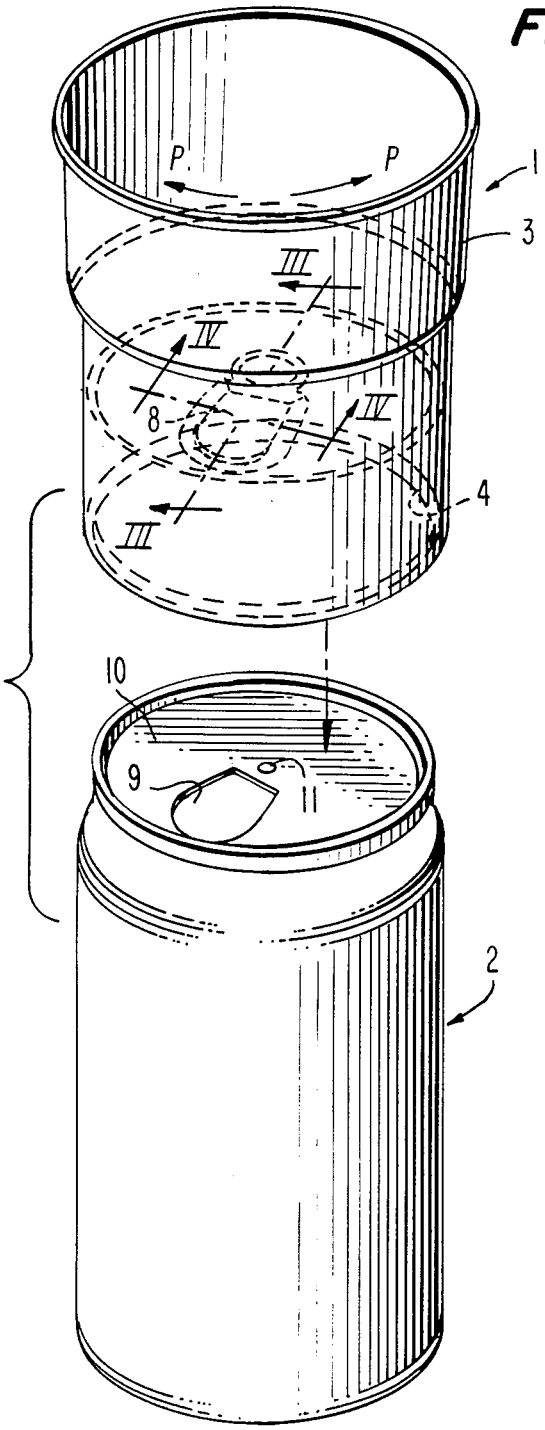
FIG. 1 shows a perspective view of a first embodiment of a set up piece and a can separate of it.
Figure 2:
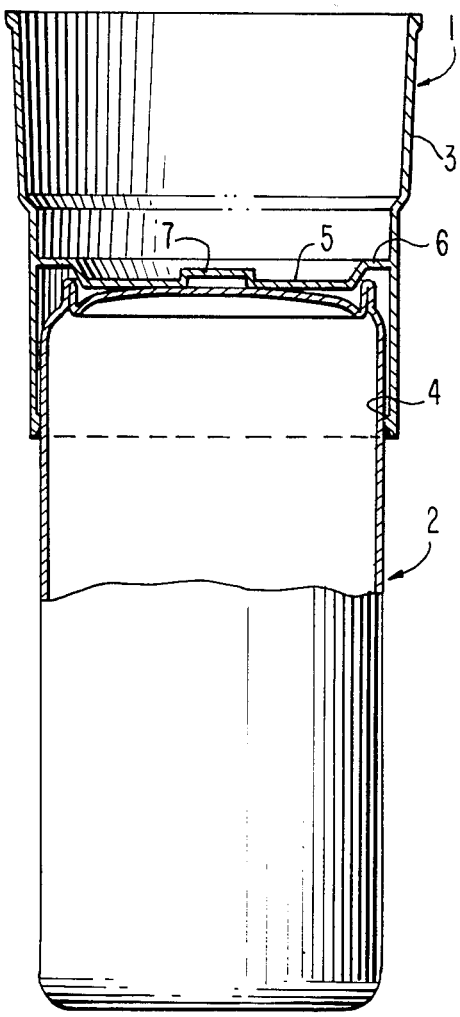
FIG. 2 shows a longitudinal section of the set up piece according to FIG. 1 clamped on a can.

FIG. 1 shows a set up piece 1 separate from the can 2. In FIG. 2 the set up piece 1 is mounted on the can 2.

The set up piece 1 comprises a substantially cylindrical wall 3 which at its lower end is provided with a rib 4 by which a tight connection between the set up piece 1 and the can 2 can be obtained.

The set up piece 1 is provided with a bottom or disk 5 which by means of a raised angular portion 6 is connected to the cylindrical wall 3. Further the bottom 5 is having a raised centre portion 7.

The bottom 5 is provided with an opening or appearance 8 as particularly appears from the FIGS. 1, 3, 4 and 5. The opening 8 can cooperate with the opening 9 in the lid 10 of the can 2. When the set up piece 1 is slid onto the can 2, as indicated in FIG. 2, the set up piece 1 can be rotated in the direction of the arrow P (FIG. 1) to bring the openings 8 and 9 in line with each other when one wants to drink out of the can. When the opening 9 has to be closed the upset piece can be rotated till the opening 9 is closed off by the bottom 5 of the set up piece.

The raised centre portion 7 is present to prevent contact between the bottom 5 and parts 11 (FIG. 1) which might be present as part of the means by which the opening 9 in the lid 10 of the can 2 was originally closed.

Figure 3:
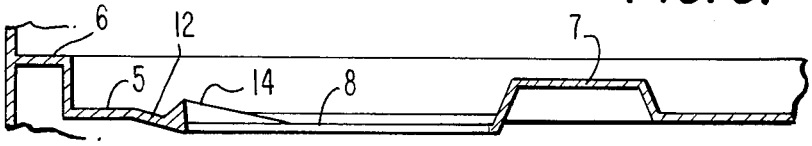
FIG. 3 shows a sectional view of a detail of the set up piece according to the line III—III of FIG. 1.
Figure 4:
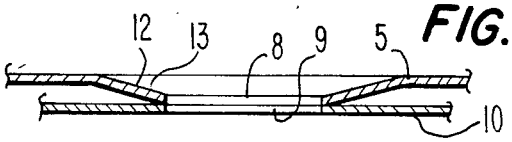
FIG. 4 shows a sectional view according to the line IV—IV of FIG. 1.

As appears from the FIGS. 3 and 4 the opening or aperture 8 in the bottom 5 of the set up piece 1 is surrounded by somewhat slanted bottom portions 12 which will engage the edge 13 of the opening 9 in the lid 10 as appears in particular from FIG. 4. By this it is prevented that droplets of liquid will be sucked in the space between the bottom 5 and the lid 10. Further a little rib 14 is provided around the rounded off portion of the opening 8 where this is nearest to the cylindrical wall 3, such that the height of said rib is decreasing from that place, as appears from FIG. 3.

Figure 5:
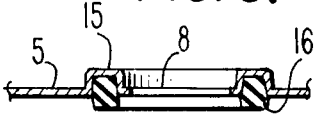
FIG. 5 shows a sectional view according to FIG. 4 but of another embodiment of the edges of the opening in the set up piece.

FIG. 5 shows the possibility that around the opening 8 in the bottom 5 of the set up piece a groove 15 is provided, in which a ring 16 can be positioned, said ring being made of a resilient material.

Figure 6:
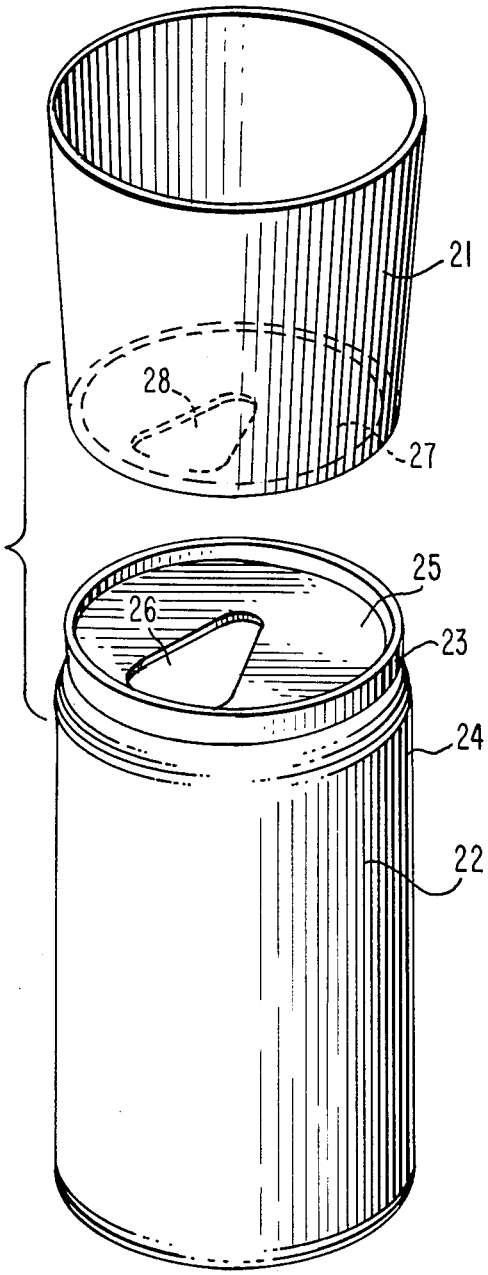
FIG. 6 shows a perspective view of a second embodiment of a set up piece and a can separate of it.
Figure 7:
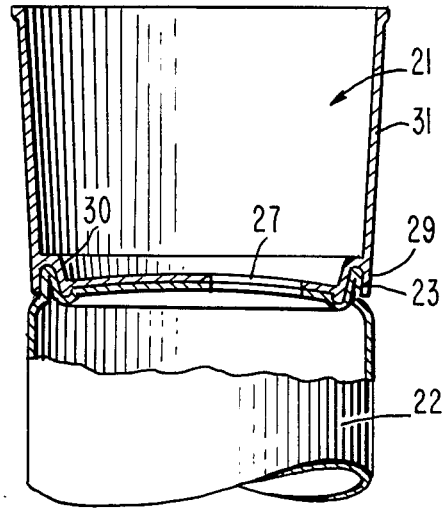
FIG. 7 shows a longitudinal section of the set up piece of FIG. 6 clamped on a can.

FIGS. 6 and 7 show another embodiment of a set up piece 21 according to the present invention for mounting on a can 22, which is provided with a flange rim 23 where the cylindrical portion 24 of the can 22 is joined with the lid 25 of the can.

In this case the opening 26 in the lid 25 is having a substantially triangular shape.

The set up piece 21 is having a bottom 27 in which an opening 28 is provided, the shape of which corresponds substantially with that of the opening 26 in the can 22.

The set up piece 21 can be kept on the flange rim 23 by the cooperating part 29 and 30 extending around the bottom 27 of the set up piece 21. The part 29 is an extension of the cylindrical wall 31 of the set up piece and the part 30 is forming the connection between the bottom 27 and the cylindrical wall 31.

It will be clear that, after mounting of the set up piece 21 on the can 22 the set up piece can be rotated in respect of the can 22 so that the opening 26 of the can can be in line with the opening 28 of the set up piece 21 or can be closed off by the bottom 27 of the set up piece 21.

Figure 8:
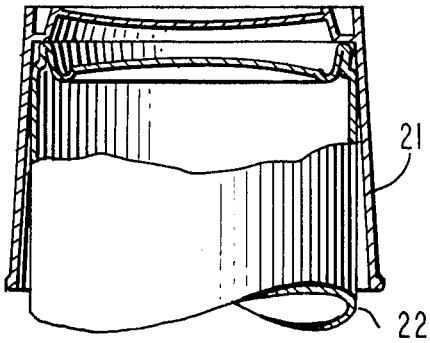
FIG. 8 shows a longitudinal section of the set up piece of FIGS. 6 and 7 upsidedown on a can.

FIG. 8 shows the possibility to place the set up piece in upsidedown position on a can 22, so that it will occupy very little space during transportation and a set up piece 21 can be delivered with a can 22.

It will be clear that the same holds for the embodiment shown in the FIGS. 1–5, although in that case the set up pieces will take somewhat more space.

Figure 9:
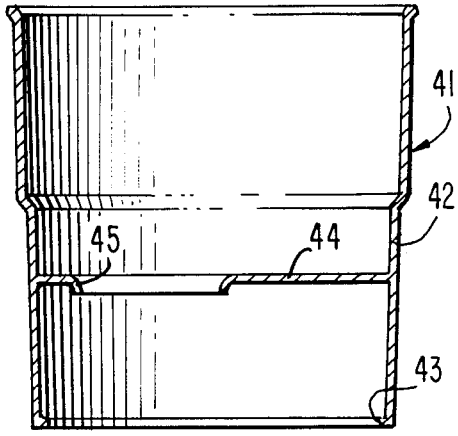
FIG. 9 shows a longitudinal section of a third embodiment of a set up piece according to the invention.

FIG. 9 shows a third embodiment of a set up piece 41 having a substantially cylindrical wall 42 which at its lower end is provided with a rib 43 as this is the case with the embodiment of FIGS. 1–5.

Now the cylindrical wall 42 is connected to an angular portion 44 which at its inner circumference is provided with a rib 45. The rib 45 can come into contact with the lid of a can but it will be clear, that in case of this embodiment the opening in the lid of the can can not be closed off.

It is obvious that the embodiment according to FIG. 9 is cheaper to fabricate and such set up pieces are taking less space when being stacked.

Although in the FIGS. 6–8 the shape of the edge of the opening 28 in the bottom 27 of the set up piece 21 is not indicated in detail, it will be clear that in that case too the bottom 27 will be shaped such that it is prevented that liquid will come into the space between the bottom 27 of the set up piece 21 and the lid 25 of the can 22. To this end e.g. the features as indicated in FIGS. 3 and 4 can be used.

It has to be remarked that the lower surface of the bottom of a set up piece, that means the surface directed towards the lid of a can, will not be smooth but somewhat roughened. This sometimes is indicated as a "structured" surface.

By this the possibility that liquid is sucked between this surface and the lid of a can is decreased.

We claim:

1. A beverage can drinking attachment comprising:

(a) a substantially cylindrical body having clamping means for obtaining a liquid tight connection between the beverage can attachment and a can top positioned at a lower end of said body;

(b) a disk extending substantially transverse across said body dividing said body into a drinking portion and clamping portion, said disk having means for engaging an upper rim of the can top;

(c) an aperture in said disk which when the can attachment is placed on the can top said aperture is alignable with a can lid opening;

(d) said clamping means comprising a straight, cylindrical skirt extending from a joint between said cylindrical body and said disk, said skirt having at a lower edge an inwardly extending rib which engages a cylindrical wall of the can substantially below an upper rim of the can, said skirt extending a substantial distance below the rim of the can when the can attachment is placed on the can top whereby the can attachment provides a substantially liquid tight engagement, regardless of the shape or diameter of the upper part of the can or upper rim of the can.

2. The attachment of claim 1, wherein a lower surface of said disk includes a raised angular portion around the periphery thereof and connected to said body portion.

3. The attachment of claim 1 wherein said disk includes a raised center portion.

4. The attachment of claim 1 including a slanted portion substantially surrounding said aperture for engagement at or near the can lid opening to prevent droplets from being sucked between said disk and the can lid.

5. The attachment of claim 4 wherein said aperture includes a resilient ring therein.

6. The attachment of claim 1 wherein the drinking portion has a diameter larger than the clamping portion.

7. The attachment of claim 6 wherein the diameter of the drinking portion is substantially larger than the can diameter whereby the attachment can fit upside down over the can.

8. The attachment of claim 6 wherein a plurality of attachments are nested.

9. The attachment of claim 1 wherein said clamping portion is greater than one-third the depth of said drinking portion.

10. The attachment of claim 1 wherein said clamping portion is greater than one-half the depth of said drinking portion.

* * * * *